US006800429B2

(12) United States Patent
Lelental et al.

(10) Patent No.: US 6,800,429 B2
(45) Date of Patent: Oct. 5, 2004

(54) IMAGING MATERIALS WITH CONDUCTIVE LAYERS CONTAINING ELECTRONICALLY CONDUCTIVE POLYMER PARTICLES

(75) Inventors: Mark Lelental, Rochester, NY (US); Charles C. Anderson, Penfield, NY (US); John M. Pochan, Penfield, NY (US); James L. Wakley, Brockport, NY (US); James F. Elman, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/036,155

(22) Filed: Dec. 26, 2001

(65) Prior Publication Data

US 2003/0134211 A1 Jul. 17, 2003

(51) Int. Cl.[7] ..... G03C 1/89; G03C 1/498; G03C 1/46; G03G 5/10

(52) U.S. Cl. ..... 430/502; 430/62; 430/69; 430/200; 430/201; 430/510; 430/529; 430/527; 503/227

(58) Field of Search ..... 430/62, 69, 200, 430/201, 502, 510, 527, 529; 503/227

(56) References Cited

U.S. PATENT DOCUMENTS

| | | | | |
|---|---|---|---|---|
| 4,070,189 | A | 1/1978 | Kelley et al. | |
| 4,175,969 | A | 11/1979 | Mackey | |
| 4,649,102 | A | 3/1987 | Mukunoki et al. | |
| 4,731,408 | A | 3/1988 | Jasne | |
| 4,891,307 | A | 1/1990 | Mukunoki et al. | |
| 4,987,042 | A | 1/1991 | Jonas et al. | |
| 5,093,439 | A | 3/1992 | Epstein et al. | |
| 5,138,024 | A | 8/1992 | Brozek et al. | |
| 5,217,804 | A | 6/1993 | James et al. | |
| 5,236,817 | A | 8/1993 | Kim et al. | |
| 5,252,444 | A | 10/1993 | Yamada et al. | |
| 5,288,598 | A | 2/1994 | Sterman et al. | 430/496 |
| 5,300,575 | A | 4/1994 | Jonas et al. | 525/186 |
| 5,312,681 | A | 5/1994 | Muys et al. | 430/527 |
| 5,354,613 | A | 10/1994 | Quintens et al. | 428/341 |
| 5,368,894 | A | 11/1994 | Lammers et al. | |
| 5,370,981 | A | 12/1994 | Krafft et al. | 430/529 |
| 5,372,924 | A | 12/1994 | Quintens et al. | 430/527 |
| 5,391,472 | A | 2/1995 | Muys et al. | 430/527 |

(List continued on next page.)

FOREIGN PATENT DOCUMENTS

| | | |
|---|---|---|
| EP | 0 650 088 A2 | 4/1995 |
| EP | 1 003 179 A | 5/2000 |
| GB | 1 293 189 | 10/1971 |
| GB | 1 259 398 | 1/1972 |
| GB | 1 330 356 | 9/1973 |
| GB | 1 524 631 | 3/1975 |
| GB | 2 299 680 | 10/1996 |

OTHER PUBLICATIONS

Lelental et al., Composition Containing Electrically Conductive Particles, USSN 10/036,126 filed Dec. 26, 2001.

(List continued on next page.)

*Primary Examiner*—Richard L. Schilling
(74) *Attorney, Agent, or Firm*—Doreen M. Wells; J. Lanny Tucker

(57) ABSTRACT

An imaging material comprising a support having disposed thereon: a) at least one image-formning layer, and b) at least one transparent electrically conductive antistatic layer that comprises electronically conductive polymer particles, a neutral-charge conductivity enhancer, and a polymeric binder comprising gelatin or gelatin derivatives.

34 Claims, 2 Drawing Sheets

U.S. PATENT DOCUMENTS

| | | | | |
|---|---|---|---|---|
| 5,403,467 | A | 4/1995 | Jonas et al. | |
| 5,443,944 | A | 8/1995 | Krafft et al. | 430/529 |
| 5,575,898 | A | 11/1996 | Wolf et al. | |
| 5,665,498 | A | 9/1997 | Savage et al. | 430/529 |
| 5,674,654 | A | 10/1997 | Zumbulyadis et al. | 430/537 |
| 5,766,515 | A | 6/1998 | Jonas et al. | 252/500 |
| 6,077,655 | A | 6/2000 | Majumdar et al. | |
| 6,083,635 | A | 7/2000 | Jonas et al. | 252/500 |
| 6,197,418 | B1 | 3/2001 | Cloots et al. | 428/332 |
| 6,440,654 | B1 * | 8/2002 | Anderson et al. | 430/529 |

OTHER PUBLICATIONS

JP patent abstract, Kokai No. 63–063035, Sep. 1989.
Research Disclsoure, Dec. 1978, Item No. 17643.
Research Disclosure, Nov. 1992, Item No. 34390.
Research Disclosure, Sep. 1994, Item No. 36544.
Research Disclosure, Jun. 1994, Item No. 36230.
Research Discloure, Jan. 1983, Item No. 22534.
Research Disclosure, Feb. 1995, Item No. 37038.

* cited by examiner

IMAGING MATERIALS WITH CONDUCTIVE LAYERS CONTAINING ELECTRONICALLY CONDUCTIVE POLYMER PARTICLES

CROSS REFERENCE TO RELATED APPLICATIONS

This application relates to commonly assigned copending application Ser. No. 10/036,126 , filed simultaneously herewith. This copending application is incorporated by reference herein for all that they contain.

FIELD OF THE INVENTION

This invention relates in general to imaging elements, such as photographic, electrostatographic, and thermal imaging elements containing one or more conductive antistatic layers. In particular, the invention relates to imaging elements comprising a support, an image-forming layer and an electronically-conductive antistatic layer comprising specific conductive polymeric particles. This invention is directed to imaging sciences in general and to photography, thermography, and photothermography more specifically.

BACKGROUND OF THE INVENTION

Problems associated with the generation and discharge of electrostatic charge during the manufacture and use of photographic films and paper products have been recognized for many years by the photographic industry. The accumulation of static charge on film or paper surfaces can cause irregular static marking fog patterns in the emulsion layer. The presence of static charge also can lead to difficulties in support conveyance as well as the attraction of dust that can result in, fog, desensitization, and other physical defects during emulsion coating. The discharge of accumulated charge during or after the application of the imaging emulsion layer(s) also can produce irregular fog patterns or "static marks" in the emulsion layer. The severity of static-related problems has been exacerbated greatly by increases in the sensitivity of new emulsions, increases in coating machine speeds, and increases in post-coating drying efficiency.

The generation of electrostatic charge during the coating process results primarily from the tendency of webs to undergo triboelectric charging during winding and unwinding operations, during conveyance through the coating machines, and during finishing operations such as slitting and spooling.

Static charge can also be generated during the use of the final photographic film product. In an automatic camera, the winding of roll film out of and back into the film cassette, especially in a low relative humidity environment, can result in static charging and marking. Similarly, high-speed automated film processing equipment can produce static charging resulting in marking. Sheet films are especially subject to static charging during use in automated high-speed film cassette loaders (for example, radiographic and graphic arts films).

It is widely known and accepted that accumulated electrostatic charge can be dissipated effectively by incorporating one or more electrically conductive "antistatic" layers into the overall film structure. Antistatic layers can be applied to one or to both sides of the film support as subbing layers either underlying or on the side opposite to the sensitized emulsion layer. Alternatively, an antistatic layer can be applied as the bottom layers, intermediate layers, or outermost coated layer either over the emulsion layers (that is, as an overcoat), or on the side of the film support opposite to the emulsion layers (that is, as a back coat) or both.

A wide variety of electrically conductive materials can be incorporated in antistatic layers to produce a broad range of surface conductivities. Many of the traditional antistatic layers used for photographic applications employ materials that exhibit predominantly ionic conductivity. Antistatic layers containing simple inorganic salts, alkali metal salts of surfactants, alkali metal ion-stabilized colloidal metal oxide sols, ionic conductive polymers or polymeric electrolytes containing alkali metal salts and the like have been taught in the art. The electrical conductivities of such ionic conductors are typically strongly dependent on the temperature and relative humidity of the surrounding environment. At low relative humidity and low temperatures, the diffusion mobility of the charge carrying ions are greatly reduced and the bulk conductivity is substantially decreased. At high relative humidity, an exposed antistatic back coating can absorb water, swell, and soften. Especially in the case of roll films, this can result in a loss of adhesion between layers as well as physical transfer of portions of the back coating to the emulsion side of the film (viz. blocking). Also, many of the inorganic salts, polymeric electrolytes, and low molecular weight surface-active agents typically used in such antistatic layers are water soluble and can be leached out during film processing, resulting in a loss of antistatic faction.

One of the methods proposed in the art for increasing the electrical conductivity of the surface of photographic light-sensitive materials in order to dissipate accumulated electrostatic charge involves the incorporation of at least one of a wide variety of surfactants or coating aids in the outermost (surface) protective layer overlying the emulsion layer(s). A wide variety of ionic-type surfactants have been evaluated as antistatic agents including anionic, cationic, and betaine-based surfactants of the type described. The use of nonionic surfactants having at least one polyoxyethylene group as antistatic agents is also known. Further, surface protective layers containing nonionic surfactants having at least two polyoxyethylene groups are known.

In order to provide improved performance, the incorporation of an anionic surfactant having at least one polyoxyethylene group in combination with a nonionic surfactant having at least one polyoxyethylene group in the surface layer was disclosed in U.S. Pat. No. 4,649,102. A further improvement in antistatic performance by incorporating a fluorine-containing ionic surfactant having a polyoxyethylene group into a surface layer containing either a nonionic surfactant having at least one polyoxyethylene group or a combination of nonionic and anionic surfactants having at least one polyoxyethylene group was disclosed in U.S. Pat. Nos. 4,510,233 and 4,649,102. Additionally, surface or backing layers comprising a combination of specific cationic and anionic surfactants having at least one polyoxyethylene group in each which form a water-soluble or dispersible complex with a hydrophilic colloid binder are disclosed in European Patent Publication 650,088 and British Patent Publication 2,299,680 to provide good antistatic properties both before and after processing without dye staining.

Surface layers containing either non-ionic or anionic surfactants having polyoxyethylene groups often demonstrate specificity in their antistatic performance such that good performance can be obtained against specific supports and photographic emulsion layers but poor performance results when they are used with others. Surface layers containing fluorine-containing ionic surfactants of the type described in U.S. Pat. Nos. 3,589,906, 3,666,478, 3,754,924, 3,775,236, and 3,850,642, British Patant Nos. 1,293,189, 1,259,398, 1,330,356, and 1,524,631 generally exhibit negatively charged triboelectrification when brought into contact with various materials. Such fluorine-containing ionic surfactants exhibit variability in triboelectric charging properties after extended storage, especially after storage at high relative humidity.

However, it is possible to reduce triboelectric charging from contact with specific materials by incorporating into a surface layer other surfactants which exhibit positively charged triboelectrification against these specific materials. The dependence of the triboelectrification properties of a surface layer on those specific materials with which it is brought into contact can be somewhat reduced by adding a large amount of fluorine-containing nonionic surfactants of the type disclosed in U.S. Pat. No. 4,175,969.

However, the use of a large amount of said fluorine-containing surfactants results in decreased emulsion sensitivity, increased tendency for blocking, and increased dye staining during processing. Thus, it is extremely difficult to minimize the level of triboelectric charging against all those materials with which an imaging element may come to contact without seriously degrading other requisite performance characteristics of the imaging element.

The inclusion in a surface or backing layer of a combination of three kinds of surfactants, comprising at least one fluorine-containing nonionic surfactant, and at least one fluorine-containing ionic surfactant, and a fluorine-free nonionic surfactant has been disclosed in U.S. Pat. No. 4,891,307 to reduce triboelectric charging, prevent dye staining on processing, maintain antistatic properties on storage, and preserve sensitometric properties of the photosensitive emulsion layer. The level of triboelectric charging of surface or backing layers containing said combination of surfactants against dissimilar materials (for example, rubber and nylon) is alleged to be such that little or no static marking of the sensitized emulsion occurs. The incorporation of another antistatic agent such as colloidal metal oxide particles of the type described in U.S. Pat. Nos. 3,062,700 and 3,245,833 into the surface layer containing said combination of surfactants was also disclosed in U.S. Pat. No. 4,891,307.

The use of a hardened gelatin-containing conductive surface layer containing a soluble antistatic agent (for example TERGITOL 15-S-7), an aliphatic sulfonate-type surfactant (for example HOSTAPUR SAS-93), a matting agent (for example silica, titania, zinc oxide, and polymeric beads), and a friction-reducing agent (for example Slip-Ayd SL-530) for graphic arts and medical x-ray films has been taught in U.S. Pat. No. 5,368,894.

Further, a method for producing such a multilayered photographic element in which the conductive surface layer is applied in tandem with the underlying sensitized emulsion layer(s) is also claimed in U.S. Pat. No. 5,368,894. A surface protective layer comprising a composite matting agent consisting of a polymeric core particle surrounded by a layer of colloidal metal oxide particles and optionally, conductive metal oxide particles and a nonionic, anionic or cationic surfactant has been disclosed in U.S. Pat. No. 5,288,598.

An electroconductive protective overcoat overlying a sensitized silver halide emulsion layer of a black-and white photographic element comprising at least two layers both containing granular conductive metal oxide particles and gelatin but at different metal oxide particle-to-gelatin weight ratios has been taught in Japanese Kokai 63-063035. The outermost layer of said protective layer contains a substantially lower total dry coverage of conductive metal oxide (for example, 0.75 g/m$^2$ compared to 2.5 g/m$^2$) present at a lower metal oxide particle-to-gel weight ratio (e.g., 2:1 vs 4:1) than that of the innermost conductive layer.

Antistatic layers incorporating electronic rather than ionic conductors also have been described extensively in the art. Because the electrical conductivity of such layers depends primarily on electronic mobility rather than on ionic mobility, the observed conductivity is independent of relative humidity and only slightly influenced by ambient temperature. Antistatic layers containing conjugated conductive polymers, conductive carbon particles, crystalline semiconductor particles, amorphous semiconductive fibrils, and continuous semiconductive thin films or networks are well known in the art. Of the various types of electronic conductors previously described, electroconductive metal-containing particles, such as semiconductive metal oxide particles, are particularly effective. Fine particles of crystalline metal oxides doped with appropriate donor heteroatoms or containing oxygen deficiencies are sufficiently conductive when dispersed with polymeric film-forming binders to be used to prepare optically transparent, humidity insensitive, antistatic layers useful for a wide variety of imaging applications, as disclosed in for example U.S. Pat. Nos. 4,275,103, 4,416,963, 4,495,276, 4,394,441, 4,418,141, 4,431,764, 4,495,276, 4,571,361, 4,999,276, 5,122,445, 5,294,525, 5,368,995, 5,382,494, and 5,459,021. Suitable claimed conductive metal oxides include zinc oxide, titania, tin oxide, alumina, indium oxide, zinc and indium antimonates, silica, magnesia, zirconia, barium oxide, molybdenum trioxide, tungsten trioxide, and vanadium pentoxide. Of these, the semiconductive metal oxide most widely used in conductive layers for imaging elements is a crystalline antimony-doped tin oxide, especially with a preferred antimony dopant level between 0.1 and 10 atom percent Sb (for $Sb_xSn_{1-x}O_2$) as disclosed in U.S. Pat. No. 4,394,441.

Electronically conductive polymers have recently received attention from various industries because of their electronic conductivity. Although many of these polymers are highly colored and are less suited for photographic applications, some of these electronically conductive polymers, such as substituted or unsubstituted pyrrole-containing polymers (as mentioned in U.S. Pat. Nos. 5,665,498 and 5,674,654), substituted or unsubstituted thiophene-containing polymers (as mentioned in U.S. Pat. Nos. 5,300,575, 5,312,681, 5,354,613, 5,370,981, 5,372,924, 5,391,472, 5,403,467, 5,443,944, 5,575,898, 4,987,042, and 4,731,408) and substituted or unsubstituted aniline-containing polymers (as mentioned in U.S. Pat. Nos. 5,716,550, 5,093,439, and 4,070,189) are transparent and not prohibitively colored, at least when coated in thin layers at moderate coverage. Because of their electronic conductivity instead of ionic conductivity, these polymers are conducting even at low humidity. Moreover, some of these polymers can retain sufficient conductivity even after wet chemical processing to provide what is known in the art as "process-surviving" antistatic characteristics to the photographic support they are applied. Unlike metal-containing semi-conducting particulate antistatic materials (e.g., antimony-doped tin oxide), the aforementioned electronically conductive polymers are less abrasive and environmentally more acceptable (due to absence of heavy metals).

U.S. Pat. No. 5,312,681 describes a thiophene-containing antistatic layer having an overlying barrier layer, and onto the said barrier layer is applied an adhesion promoting hydrophilic colloid layer. Reportedly, this combination of 3 layers provides effective antistatic protection and adhesion to overlying hydrophilic colloid layers such as photographic emulsion layers. U.S. Pat. No. 6,077,655 describes hydrophilic antistatic layers containing an electronically conductive polymer and a modified gelatin that is a graft copolymer of gelatin and a vinyl polymer having acid functionality. The said modified gelatin is used rather than conventional gelatin in order to achieve effective antistatic performance.

The use of electroconductive antimony-doped tin oxide granular particles in combination with at least one fluorine-containing surfactant in a surface, overcoat or backing layer has been disclosed broadly in U.S. Pat. Nos. 4,495,276, 4,999,276, 5,122,445, 5,238,801, 5,254,448, and 5,378,577 and also in Japanese Kokai 07-020,610 and Japanese Kokoku 91-024,656B1. Such fluorine-containing surfactants are preferably located in the same layer as the electroconductive tin oxide particles to provide improved antistatic performance. A surface protective layer or a backing layer comprising at least one fluorine-containing surfactant, at least one nonionic surfactant having at least one polyoxyethylene group, and optionally one or both of electroconductive metal oxide granular particles or a conductive polymer or conductive latex is disclosed in U.S. Pat. No. 5,582,959.

As indicated herein above, the art discloses a wide variety of antistatic layer compositions. However, there is still a critical need in the art for electrically conductive, hydrophilic antistatic layers that effectively facilitate dissipation of accumulated electrostatic charge, but also minimize triboelectric charging against a wide variety of materials with which the imaging element may come into contact. In addition to providing superior antistatic performance, the antistatic layers also must be highly transparent, resist the effects of humidity change, strongly adhere to adjacent layers, particularly hydrophilic layers such as photographic emulsion layers, exhibit suitable dynamic and static wettability , not exhibit ferrotyping or blocking, not exhibit adverse sensitometric effects, and still be manufacturable at a reasonable cost.

It is toward the objective of providing such improved electrically conductive, antistatic layers that more effectively meet the diverse needs of imaging elements, especially of silver halide photographic films, than those of the prior art that the present invention is directed.

SUMMARY OF THE INVENTION

In accordance with this invention, an imaging element for use in an image-forming process is comprised of a support, an image-forming layer and an electrically-conductive layer comprising particles of electronically-conductive polymer dispersed in a film-forming hydrophilic binder. The addition of a neutral charge conductivity enhancing agent can provide improved conductivity for said conductive layers. The imaging elements of this invention can contain one or more image-forming layers and one or more electrically-conductive layers and such layers can be coated on any of a very wide variety of supports. Use of an electronically-conductive polymer-neutral charge conductivity enhancer combination dispersed in a suitable film-forming, hydrophilic, polymeric binder enables the preparation of a thin, highly conductive, transparent layer which is strongly adherent to photographic supports as well as to overlying layers such as emulsion layers, pelloids, topcoats, backcoats, and the like. The electrical conductivity provided by the conductive layer of this invention is independent of relative humidity and persists even after exposure to aqueous solutions with a wide range of pH values such as are encountered in the processing of photographic elements. As hereinafter described in full detail, it has been discovered that layers containing doped electronically conductive polymer-hydrophilic binder provide superior performance when used as electrically-conductive antistatic subbing layers for a wide variety of imaging elements.

The present invention provides aqueous mixtures of an electronically conductive polymer, a neutral charge conductivity enhancer and a hydrophilic polymeric binder. These aqueous formulations can be applied as thin coatings to the substrate and dried to form transparent electrically conducting antistatic subbing layers. Preferred electronically conductive polymers include polypyrrole/poly (styrene sulfonic acid), 3,4-dialkoxy substituted polypyrrole styrene sulfonate, and 3,4-dialkoxy substituted polythiophene styrene sulfonate.

Especially preferred electronically conductive polymers are polythiophenes of formula (I)

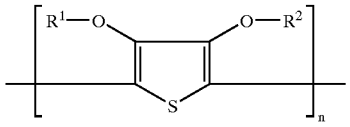

I

Polythiophene Formula (I)

wherein n is about 5 to 1000 and wherein $R_1$ and $R_2$ are independently hydrogen or a substituted or unsubstituted alkyl group having 1 to 4 carbon atoms, or together form a substituted or unsubstituted group or a substituted or unsubstituted 1,2-cyclohexylene group.

The neutral charge conductivity enhancers of this invention include organic compounds containing dihydroxy or poly-hydroxy and/or carboxyl groups or amide groups or lactam groups.

DETAILED DESCRIPTION OF THE INVENTION

Figure 1:
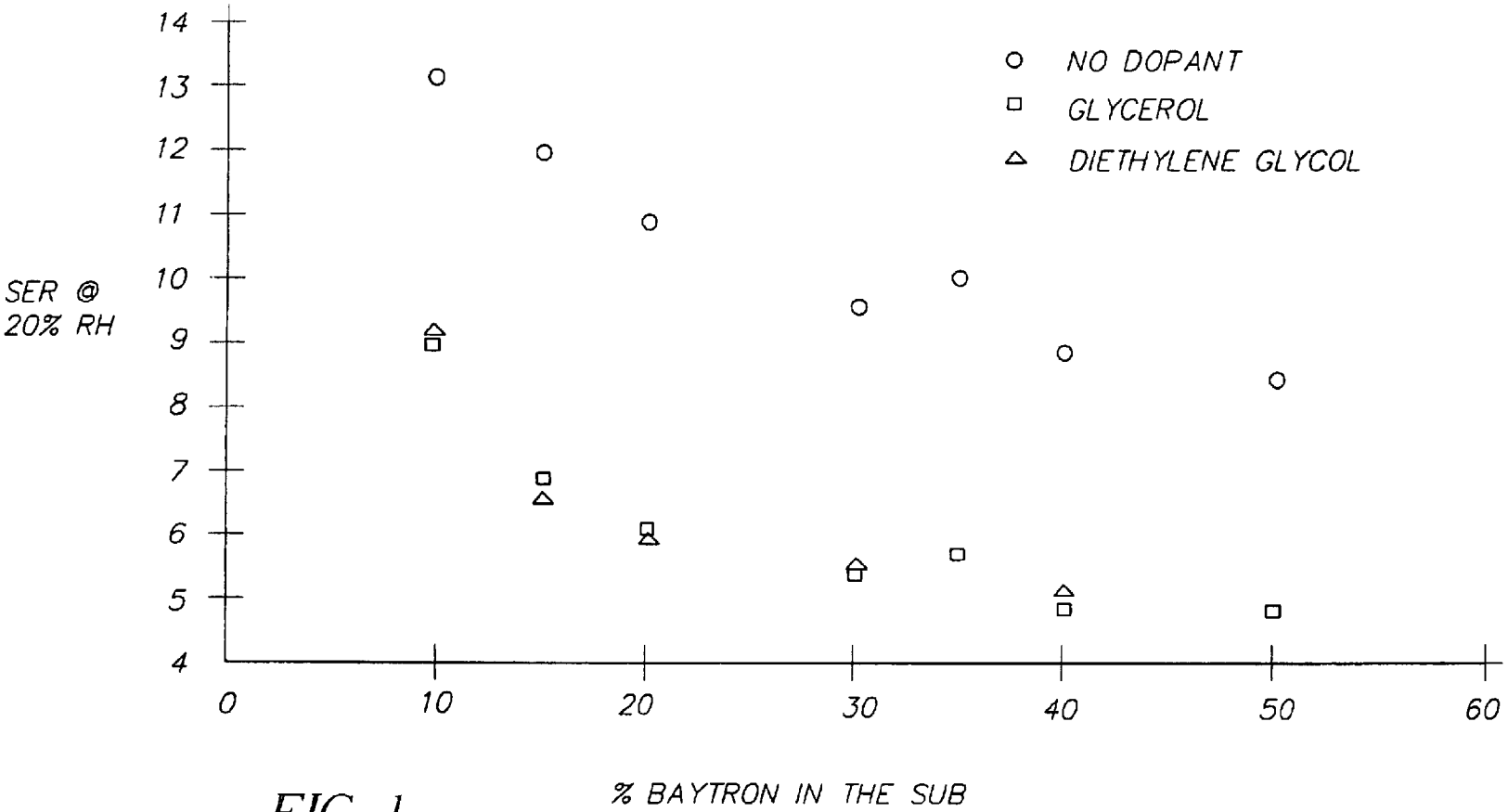
FIG. 1 shows the percentage of Baytron in the sublayer.

The method for preparing the noted electrically conductive layers in accordance with this invention comprises preparing a stable aqueous colloidal dispersion of one or more electronically conductive polymeric materials. Preferably, such colloidal dispersions are combined with at least one neutral charge conductivity enhancer, one or more polymeric film-forming binders, thickeners, and other additives, and incorporated in an imaging element in the form of a thin antistatic subbing layer.

The electronically conductive polymer particles can be coated out of aqueous coating compositions. The polymers can be chosen from any or a combination of electronically conductive polymers, such as substituted or unsubstituted pyrrole-containing polymers (as mentioned for example, in U.S. Pat. Nos. 5,665,498 and 5,674,654), substituted or unsubstituted thiophene-containing polymers (as mentioned for example, in U.S. Pat. Nos. 5,300,575, 5,312,681, 5,354,613, 5,370,981, 5,372,924, 5,391,472, 5,403,467, 5,443,944, 5,575,898, 4,987,042, and 4,731,408), and substituted or unsubstituted aniline-containing polymers (as mentioned for example, in U.S. Pat. Nos. 5,716,550, 5,093,439, and 4,070,189).

Polyanions used in these electronically conductive polymers include the anions of polymeric carboxylic acids such as polyacrylic acids, poly(methacrylic acid), and poly (maleic acid), and polymeric sulfonic acids such as polystyrenesulfonic acids and polyvinylsulfonic acids, the polymeric sulfonic acids being preferred for use in this invention. These polycarboxylic and polysulfonic acids may also be copolymers formed from vinylcarboxylic and vinylsulfonic acid monomers copolymerized with other polymerizable monomers such as the esters of acrylic acid and styrene. The molecular weight of the polyacids providing the polyanions preferably is 1,000 to 2,000,000 and more preferably 2,000 to 500,000. The polyacids or their alkali salts are commonly available, for example as polystyrenesulfonic acids and polyacrylic acids, or they may be produced using known methods. Instead of the free acids required for the formation of the electronically conducting polymers and polyanions, mixtures of alkali salts of polyacids and appropriate amounts of monoacids may also be used.

Preferred electronically conductive polymers include polypyrrole/poly (styrene sulfonic acid), 3,4-dialkoxy substituted polypyrrole styrene sulfonate, and 3,4-dialkoxy substituted polythiophene styrene sulfonate. The electronically conductive polymer particles exhibit a packed powder specific resistivity of $10^5$ ohm.cm or less; have a mean diameter of 0.5 $\mu$m or less, preferably 0.1 $\mu$m or less.

The electronically conductive polymers may be soluble or dispersible in organic solvents or water or mixtures thereof For environmental reasons, aqueous systems are preferred. While the electronically conductive polymer particles can be used without a binder in the various antistatic layers, preferably, they are dispersed in one or more hydrophilic polymeric, film-forming, binders. In such embodiments, the volume fraction of electronically conductive polymer is preferably in the range of from 5 to 95% of the weight of the polymer particle/binder combination. Preferably, the weight % of polymeric particles is from 10 to 90%. The use of significantly less than 5 weight % polymer particles will not provide a useful level of surface electrical conductivity. The optimum volume ratio of polymer particles to film-forming polymer binder varies depending on the electrical properties of the polymer, binder type, type of neutral charge conductivity enhancer, and conductivity requirements of the particular image-forming material. The choice of the particular neutral charge conductivity enhancer to be used with the electronically conductive polymer in the antistatic layer can be advantageous to the benefits provided by the present invention. The combination of neutral charge conductivity enhancer and electronically conductive polymer can be optimized so as to provide a maximum level of conductivity and a maximum efficiency of electrostatic charge dissipation. Typically, the concentration of the neutral charge conductivity enhancer in the antistatic layer coating solution is from 0.02 weight % to 20 weight % and preferably from 0.3 weight % to 3 weight %. The neutral-charge conductivity enhancer is present in the antistatic layer in an amount of from 0.02 to 90 weight %, based on the total weight coverage of the antistatic layer.

Polymeric film-forming hydrophilic binders useful in electrically conductive layers according to this invention can include, but are not limited to, water-soluble or water-dispersible hydrophilic polymers such as gelatin, gelatin derivatives, maleic acid anhydride copolymers, cellulose derivatives (such as carboxymethyl cellulose, hydroxyethyl cellulose, cellulose acetate butyrate, diacetyl cellulose, and triacetyl cellulose), synthetic hydrophilic polymers (such as polyvinyl alcohol, poly-N-vinylpyrrolidone, acrylic acid copolymers, polyacrylamide, their derivatives and partially hydrolyzed products and other hydrophilic synthetic resins that would be readily apparent to one skilled in the imaging arts. Gelatin and gelatin derivatives are the preferred binders in the practice of this invention.

The neutral charge conductivity enhancers of this invention include organic compounds containing dihydroxy or poly-hydroxy and/or carboxyl groups or amide groups or lactam groups. Suitable organic compounds containing dihydroxy or polyhydroxy and/or carboxyl groups or amide groups correspond to formula (II)

$$(OH)_n—R—(COX)_m \quad (II)$$

wherein n and m are independent of one another and denote an integer from 1 to 20, preferably from 2 to 8 and R denotes a linear, branched or cyclic alkylene radical having 2 to 20 C atoms or an optionally substituted arylene radical having 6 to 14 C atoms or a heterocyclic radical having 4 to 10 C atoms or a sugar radical or sugar alcohol radical and x denotes —OH or —NYZ, wherein Y, Z independently of one another represent hydrogen or alkyl, preferably hydrogen or $C_1$ to $C_{12}$-alkyl. Examples of suitable organic compounds containing lactam groups are N-methylpyrrolidone, pyrrolidone, caprolactam, N-methylcaprolactam, N-octylpyrrolidone.

Particularly preferred neutral charge conductivity enhancers are: sugar and sugar derivatives such as sucrose, glucose, fructose, lactose; sugar alcohols such as sorbitol, mannitol; furan derivatives such as 2-furancarboxylic acid, 3-furancarboxylic acid; alcohols such as ethylene glycol, glycerol, di- or triethylene glycol. U.S. Pat. Nos. 5,766,515, 6,083,635, and 6,197,418 describe electroconductive layers containing electronically conductive polythiophene and organic compounds containing polyhydroxy, carboxyl, amide, or lactam groups. Such compositions are reported to be useful in the preparation of electrodes for displays or other semiconductor devices. These patents do not discuss the incorporation of hydrophilic colloids in such layers nor do they teach or suggest the preparation of hydrophilic antistatic layers that are useful for applications in photographic elements.

Solvents useful for preparing dispersions and coatings of electronically conductive polymer particles for this invention include, but are not limited to water, alcohols (such as methanol, ethanol, propanol, and isopropanol), ketones (such as acetone, methyl ethyl ketone, and methyl isobutyl ketone), esters such as methyl acetate and ethyl acetate, glycol ethers such as methyl cellosolve, ethyl cellosolve), and mixtures of any of these solvents. Preferred solvents include water, alcohols, and acetone.

In addition to binders and solvents, other components that are well known in the photographic art may also be included in the electrically conductive layers used in this invention. Such addenda include but are not limited to matting agents, surfactants or coating aids, polymer lattices to improve dimensional stability, thickeners or viscosity modifiers, hardeners or crosslinking agents, soluble antistatic agents, soluble and/or solid particle dyes, antifoggants, lubricating agents, and various other conventional additives readily apparent to one skilled in the art.

Antistatic layers of the invention can be applied to a variety of supports. Typical photographic film supports are preferred and include but are not limited to, cellulose nitrate, cellulose acetate, cellulose acetate butyrate, cellulose acetate propionate, poly(vinyl acetal), poly(carbonate), poly (styrene), poly(ethylene terephthalate), poly(ethylene naphthalate), poly(ethylene terephthalate), and poly (ethylene naphthalate) having included therein a portion of isophthalic acid, 1,4-cyclohexane dicarboxylic acid or 4,4-biphenyl dicarboxylic acid used in the preparation of the film support; polyesters wherein other glycols are employed such as, for example, cyclohexanedimethanol, 1,4-butanediol, diethylene glycol, polyethylene glycol, ionomers as described in U.S. Pat. No. 5,138,024, incorporated herein by reference (such as polyester ionomers prepared using a portion of the diacid in the form of 5-sodiosulfo-1, 3-isophthalic acid or like ion containing monomers), polycarbonates, and blends or laminates of the above noted polymers. Preferred photographic film supports are cellulose acetate, poly(ethylene terephthalate), and poly(ethylene naphthalate), and most preferably poly(ethylene naphthalate) that is prepared from 2,6-naphthalene dicarboxylic acids or derivatives thereof.

Suitable supports can be either transparent or opaque depending upon the application. Transparent film supports can be either colorless or colored by the addition of a dye or pigment. Film supports can be surface-treated by various processes including corona discharge, glow discharge, UV exposure, flame treatment, e-beam treatment, or treatment with adhesion-promoting agents including dichloro- and trichloroacetic acid, phenol derivatives such as resorcinol and p-chloro-m-cresol, solvent washing or overcoated with adhesion promoting primer or tie layers containing polymers such as vinylidene chloride-containing copolymers, butadiene-based copolymers, glycidyl acrylate or methacrylate-containing copolymers, maleic anhydride-containing copolymers, condensation polymers such as polyesters, polyamides, polyurethanes, polycarbonates, and mixtures and blends thereof. Other suitable opaque or reflective supports are paper, polymer-coated papers, including polyethylene-, polypropylene-, and ethylene-butylene copolymer-coated or laminated paper, synthetic papers, and pigment-containing polyesters. Of these support materials, films of cellulose triacetate, poly(ethylene terephthalate), and poly(ethylene naphthalate) prepared from 2,6-naphthalene dicarboxylic acids or derivatives thereof are preferred.

The thickness of the support is not particularly critical. Support thickness of 2 to 10 mils (50 $\mu$m to 254 $\mu$m) are generally suitable for the materials of the present invention.

Electrically-conductive polymer/neutral charge conductivity enhancer/hydrophilic binder formulations can be prepared in the presence of appropriate levels of optional dispersing aids, colloidal stabilizing agents or polymeric co-binders by any of various mechanical stirring, mixing, homogenization or blending processes. Stable colloidal dispersions of suitable electronically conductive polymer particles can be obtained commercially, for example, a stabilized dispersion of thiophene-containing polymer supplied by Bayer Corporation as Baytron P™.

Coating formulations containing electronically-conductive polymer particles, neutral charge conductivity enhancer, polymeric hydrophilic binder(s), and additives can be applied to the aforementioned film or paper supports by any of a variety of well-known coating methods. Hand coating techniques include using a coating rod or knife or a doctor blade. Machine coating methods include air doctor coating, reverse roll coating, gravure coating, curtain coating, bead coating, slide hopper coating, extrusion coating, spin coating and the like, and other coating methods well known in the art.

The electrically conductive antistatic layer of this invention can be applied to the support at any suitable coverage depending on the specific requirements of a particular type of imaging element. For example, for silver halide photographic films, dry coating weights of the antistatic layer are typically in the range of from 0.01 to 1 g/m$^2$. Preferably the dry coverage is in the range of from 0.03 to 0.5 g/m$^2$. More preferably the dry coverage is in the range of from 0.04 to 0.25 g/m$^2$. The electronically conductive polymer particles are present in the antistatic layer at a dry coverage of from 0.002 to 0.5 g/m$^2$, preferably from 0.003 to 0.1 g/m$^2$.

The conductive layers used in this invention typically exhibit a surface resistivity (at 20% relative humidity and 20° C.) of less than $1\times10^{12}$ ohms/square, preferably less than $1\times10^{10}$ ohms/square, and more preferably less than $1\times10^{8}$ ohms/square.

The imaging materials of this invention can be of many different types depending on the particular use for which they are intended. For example, the imaging material may have at least one image-forming layer on each side of the support; it may have at least one photosensitive silver halide-containing layer on each side of the support; or it may have at least one antistatic layer on each side of the support. Such imaging materials or elements include, for example, a non-silver halide imaging layer; a thermally imageable layer, a photosensitive, thermally developable layer, an electrophotographic imaging layer; a black-and-white photographic silver halide emulsion layer, a color photographic silver halide emulsion layer, a diffusion transfer donor or receiving layer, a black-and-white photographic film or paper, a black-and-white radiographic film, an infrared radiation sensitive imaging or scannable material; a color photographic color negative or reversal film, color motion picture film or print, an ink jet element a photographic color paper, dielectric recording, dye migration, and laser dye-ablation imaging elements.

Details with respect to the composition and function of this wide variety of imaging elements are well known in the art. Particularly useful imaging materials are photosensitive imaging materials that provide color or black and white images and include one or more image-forming layers that include one or one more photosensitive silver halides.

Such photosensitive layers can contain silver halides such as silver chloride, silver bromide, silver bromoiodide, silver chlorobromide and others well known in the art. Both negative and reversal silver halide elements are contemplated for photographic materials. For reversal films, the emulsion layers described in U.S. Pat. No. 5,236,817 (especially Examples 16 and 21) are particularly suitable. Any of the known silver halide emulsion layers, such as those described in *Research Disclosure*, Vol. 176, Item 17643 (December, 1978) and *Research Disclosure*, Vol. 225, Item 22534 (January, 1983), and *Research Disclosure*, Item 36544 (September, 1994), and *Research Disclosure*, Item 37038 (February, 1995) and the references cited therein are useful in preparing photographic materials in accordance with this invention.

Photographic materials of this invention can differ widely in structure and composition. For example, they can vary greatly with regard to the type of support, the number and composition of the image-forming layers, the number of the electrically conductive layers, and the number and types of auxiliary layers that are included in the elements. For example, the antistatic layer may further comprise an anti-halation composition. In particular, photographic elements can be still films, motion picture films, radiographic films, graphic arts films, paper prints or microfiche. It is also specifically contemplated to use the electrically conductive layers in small format films as described in *Research*

*Disclosure*, Item 36230 (June 1994). Photographic materials can be either black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. Preparation and composition of such materials is well known in the art. For multicolor, multi-layer materials, layers can be coated simultaneously on the composite film support as described in U.S. Pat. Nos. 2,761,791 and 3,508,947. Additional useful coating and drying procedures are described in *Research Disclosure*, Vol. 176, Item 17643 (December, 1978).

Electrically conductive antistatic layers described herein can be incorporated into multilayer imaging materials in any of various configurations depending upon the requirements of the specific application. An electrically conductive antistatic subbing layer can be applied on the front side directly under the sensitized image-forming layer(s), on the back side of the support opposite the image-forming layer(s), as well as on both sides of the support. When the electrically conductive layer is applied under an image-forming emulsion layer, it is not necessary to apply any intermediate layers such as barrier layers or adhesion-promoting layers between the conductive layer and the emulsion layer(s), although they can optionally be present.

Alternatively, an electrically conductive antistatic layer can be applied on the backside as part of or in addition to layers used to control curl (that is, a hydrophilic pelloid layer). In the case of photographic elements used for direct or indirect exposure to X-ray radiation, the electrically conductive antistatic layer can be applied on either or both sides of the support.

In some photographic materials, the electrically conductive antistatic layer is present on only one side of the support and one or more photosensitive emulsion layers are present on both sides of the support. In other materials, one or more photosensitive emulsion layers are on only one side of the support and a pelloid layer that contains gelatin is on the backside of the support.

Electrically conductive antistatic layers of this invention can be incorporated under one or more photosensitive emulsion layer(s) or under pelloid layers, or both.

The electrically conductive layers described herein can also be incorporated in an imaging material comprising a support, one or more image-forming layers, and a transparent magnetic recording layer containing magnetic particles dispersed in a polymeric binder. Such imaging materials are well-known and are described, for example, in U.S. Pat. Nos. 3,782,947, 4,279,945, 4,302,523, 4,990,276, 5,147,768, 5,215,874, 5,217,804, 5,227,283, 5,229,259, 5,252,441, 5,254,449, 5,294,525, 5,335,589, 5,336,589, 5,382,494, 5,395,743, 5,397,826, 5,413,900, 5,427,900, 5,432,050, 5,457,012, 5,459,021, 5,491,051, 5,498,512, 5,514,528, and in *Research Disclosure*, Item No.34390 (November, 1992) and references cited therein, all of which publications are incorporated herein by reference. Such materials are particularly advantageous because they can be employed to record images by the customary imaging processes while at the same time additional information can be recorded into and read from a transparent magnetic layer by techniques similar to those employed in the magnetic recording art. The transparent magnetic recording layer comprises a film-forming polymeric binder, magnetic particles, and other optional addenda for improved manufacturability or performance such as dispersants, coating aids, fluorinated surfactants, crosslinking agents or hardeners, catalysts, charge control agents, lubricants, abrasive particles, filler particles, and plasticizers. The magnetic particles can consist of ferromagnetic oxides, complex oxides including other metals, metal alloy particles with protective oxide coatings, ferrites, and hexagonal ferrites and can exhibit a wide variety of shapes, sizes, and aspect ratios. Such magnetic particles also can contain a variety of metal dopants and optionally can be overcoated with a shell of particulate inorganic or polymeric materials to decrease light scattering as described in U.S. Pat. Nos. 5,217,804 and 5,252,444. The preferred ferromagnetic particles for use in transparent magnetic recording layers used in combination with the electrically conductive overcoat layers of this invention are cobalt surface-treated $\gamma$-$Fe_2O_3$ or magnetite with a specific surface area (BET) greater than 30 $m^2/g$.

The transparent, electrically conductive antistatic layers described herein can be incorporated under the image-forming emulsion layer(s) or under the transparent magnetic recording layer on the backside of the support.

Imaging elements incorporating conductive layers of this invention useful for other specific imaging applications such as color negative films, color reversal films, black-and-white films, color and black-and-white papers, electrographic media, thermal dye transfer recording media, laser ablation media, and other imaging applications should be readily apparent to those skilled in photographic and other imaging arts.

The present invention is further illustrated by the following examples of its practice. In these examples, commercially available Baytron p™ aqueous dispersion of poly (3,4-ethylenedioxytiophene) poly(styrenesulfonate) (PDET/PSS) electronically conductive polymer from Bayer (Industrial Chemicals Division) was evaluated.

EXAMPLE 1

A coating composition suitable for preparing an electrically-conductive layer was prepared by combining 173.9 g of demineralized water, 0.2 g gelatin, 0.3 g of a 1.0% aqueous solution of chrome alum (gelatin hardener), 0. 19 g of a 10.6% aqueous coating aid solution (10G surfactant supplied by Olin Corp.), 0.22 g of a 2% aqueous dispersion of polymethylmethacrylate matte particles and 15.39 g of a 1.3% Baytron P™ aqueous dispersion of colloidal PDET/PSS. The above-described coating composition was applied with a coating hopper to a 4-mil thick polyethyleneterephthalate film support that had been previously coated with a vinylidene chloride/acrylonitrile/itaconic acid terpolymer. The wet laydown of the coating composition applied to the film support was 16.1 $ml/m^2$ which corresponds to a PDET/PSS dry weight coverage of 16.1 $mg/m^2$. The surface electrical resistivity (SER) of the electrically-conductive layer was measured after conditioning for 24 hours at 5%, 20%, 50% or 70% R. H. using a two-probe parallel electrode method as described in U.S. Pat. No. 2,801,191. Optical density of the electrically-conductive layer was measured using an X-Rite Model 361T densitometer. The values obtained for SER and net optical density (ortho) are reported in Table 1 below.

TABLE 1

| Example # | Baytron P to Gel Ratio | Dopant | Dopant Concentration (Coating Solution) | SER log(ohm/ square) | SER log(ohm/ square) | SER log(ohm/ square) | SER log(ohm/square) | Optical Density |
|---|---|---|---|---|---|---|---|---|
| Comparative Ex. 1 | 50/50 | None | 0 | 8.3 | 8.5 | 8.6 | 8.8 | 0.007 |
| Comparative Ex. 2 | 40/60 | None | 0 | 8.8 | 8.9 | 9.0 | 9.2 | 0.007 |
| Comparative Ex. 3 | 30/70 | None | 0 | 9.4 | 9.6 | 9.82 | 9.9 | 0.007 |
| Comparative Ex. 4 | 25/75 | None | 0 | 9.9 | 10.0 | 10.3 | 10.3 | 0.007 |
| Comparative Ex. 5 | 20/80 | None | 0 | 10.6 | 10.9 | 11.0 | 11.2 | 0.007 |
| Comparative Ex. 6 | 15/85 | None | 0 | 11.7 | 12.0 | 12.3 | 12.2 | 0.006 |
| Comparative Ex. 7 | 10 to 90 | None | 0 | >14 | 13.1 | 13.9 | 12.6 | 0.006 |
| 8 | 50/50/ | Glycerol | 2 | 5.9 | 4.9 | 4.9 | 4.9 | 0.005 |
| 9 | 40/60 | Glycerol | 2 | 5.0 | 4.9 | 4.9 | 4.9 | 0.006 |
| 10 | 30/70 | Glycerol | 2 | 5.5 | 5.5 | 5.4 | 5.3 | 0.006 |
| 11 | 25/75 | Glycerol | 2 | 5.8 | 5.7 | 5.7 | 5.6 | 0.006 |
| 12 | 20/80 | Glycerol | 2 | 6.2 | 6.1 | 6.1 | 5.9 | 0.006 |
| 13 | 15/85 | Glycerol | 2 | 6.9 | 6.9 | 6.8 | 6.6 | 0.006 |
| 14 | 10 to 90 | Glycerol | 2 | 9.0 | 9.0 | 9.0 | 8.8 | 0.006 |
| 15 | 50/50 | Di(ethylene Glycol) | 2 | 5.0 | 4.9 | 4.9 | 5.0 | 0.006 |
| 16 | 40/60 | Di(ethylene Glycol) | 2 | 5.3 | 5.2 | 5.2 | 5.2 | 0.006 |
| 17 | 30/70 | Di(ethylene Glycol) | 2 | 5.6 | 5.6 | 5.6 | 5.5 | 0.006 |
| 18 | 25/75 | Di(ethylene Glycol) | 2 | 5.7 | 5.7 | 5.7 | 5.6 | 0.006 |
| 19 | 20/80 | Di(ethylene Glycol) | 2 | 6.0 | 6.0 | 6.0 | 5.9 | 0.006 |
| 20 | 15/85 | Di(ethylene Glycol) | 2 | 6.6 | 6.6 | 6.7 | 6.6 | 0.006 |
| 21 | 10 to 90 | Di(ethylene Glycol) | 2 | 9.2 | 9.2 | 9.5 | 9.4 | 0.006 |
| 22 | 50/50 | 2% N-methyl pyrrolidone | 2 | 6.4 | 6.3 | 6.3 | 6.4 | 0.005 |
| 23 | 45/55 | 2% N-methyl pyrrolidone | 2 | 6.5 | 6.4 | 6.5 | 6.4 | 0.005 |
| 24 | 40/60 | 2% N-methyl pyrrolidone | 2 | 6.6 | 6.5 | 6.5 | 6.5 | 0.005 |
| 25 | 35/65 | 2% N-methyl pyrrolidone | 2 | 6.7 | 6.5 | 6.7 | 6.7 | 0.005 |
| 26 | 30/70 | 2% N-methyl pyrrolidone | 2 | 6.7 | 6.6 | 6.6 | 6.6 | 0.005 |
| 27 | 25/75 | 2% N-methyl pyrrolidone | 2 | 6.9 | 6.8 | 6.8 | 6.9 | 0.005 |
| 28 | 50/50 | Ethylene Glycol | 0.1 | 7.6 | 7.7 | 7.9 | 8.1 | 0.006 |
| 29 | 50/50 | Ethylene Glycol | 0.3 | 6.5 | 6.6 | 6.6 | 6.6 | 0.006 |
| 30 | 50/50 | Ethylene Glycol | 1 | 5.0 | 5.0 | 5.0 | 5.0 | 0.006 |
| 31 | 50/50 | Ethylene Glycol | 3 | 4.6 | 4.6 | 4.6 | 4.6 | 0.006 |
| 32 | 50/50 | Ethylene Glycol | 10 | 4.6 | 4.6 | 4.6 | 4.6 | 0.006 |
| 33 | 50/50 | Di(ethylene Glycol0 | 0.1 | 7.5 | 7.6 | 7.7 | 8.0 | 0.006 |
| 34 | 50/50 | Di(ethylene Glycol) | 0.3 | 6.5 | 6.4 | 6.5 | 6.6 | 0.007 |
| 35 | 50/50 | Di(ethylene Glycol1 | 1 | 5.4 | 5.3 | 5.4 | 5.5 | 0.006 |
| 36 | 50/50 | Di(ethylene Glycol) | 3 | 4.7 | 4.7 | 4.6 | 4.7 | 0.007 |
| 37 | 50/50 | Di(ethylene Glycol2 | 10 | 4.8 | 4.7 | 4.8 | 4.7 | 0.007 |
| 38 | 50/50 | Glycerol | 0.1 | 8.0 | 8.1 | 8.3 | 8.5 | 0.006 |
| 39 | 50/50 | Glycerol | 0.3 | 6.9 | 7.0 | 7.0 | 7.1 | 0.006 |
| 40 | 50/50 | Glycerol | 1 | 4.9 | 4.9 | 4.9 | 4.9 | 0.006 |
| 41 | 50/50 | Glycerol | 3 | 4.9 | 4.8 | 4.8 | 4.9 | 0.006 |
| 42 | 50/50 | Glycerol | 10 | 5.1 | 5.0 | 5.0 | 5.0 | 0.006 |
| 43 | 50/50 | N-methyl pyrrolidone | 0.1 | 7.5 | 7.5 | 7.6 | 7.9 | |
| 44 | 50/50 | N-methyl pyrrolidone | 0.3 | 6.5 | 6.5 | 6.7 | 6.7 | |
| 45 | 50/50 | N-methyl pyrrolidone | 1 | 6.1 | 6.1 | 6.1 | 6.1 | 0.004 |
| 46 | 50/50 | N-methyl pyrrolidone | 3 | 6.1 | 6.1 | 6.3 | 6.2 | 0.005 |

EXAMPLES 2–46

Additional electrically-conductive coatings containing an organic neutral charge conductivity enhancer and(or) different Baytron P™ to gelatin ratio were prepared by incorporating a neutral charge conductivity enhancer at the concentration as reported in Table 1 and adjusting the amount of gelatin in the melt formulation to achieve Baytron P™ to gel ratio as reported in Table 1. Coatings were prepared as described in Example 1. The surface resistivities and net optical densities of these electrically-conductive layers were measured in the manner described above and are reported in Table 1.

Figure 2:
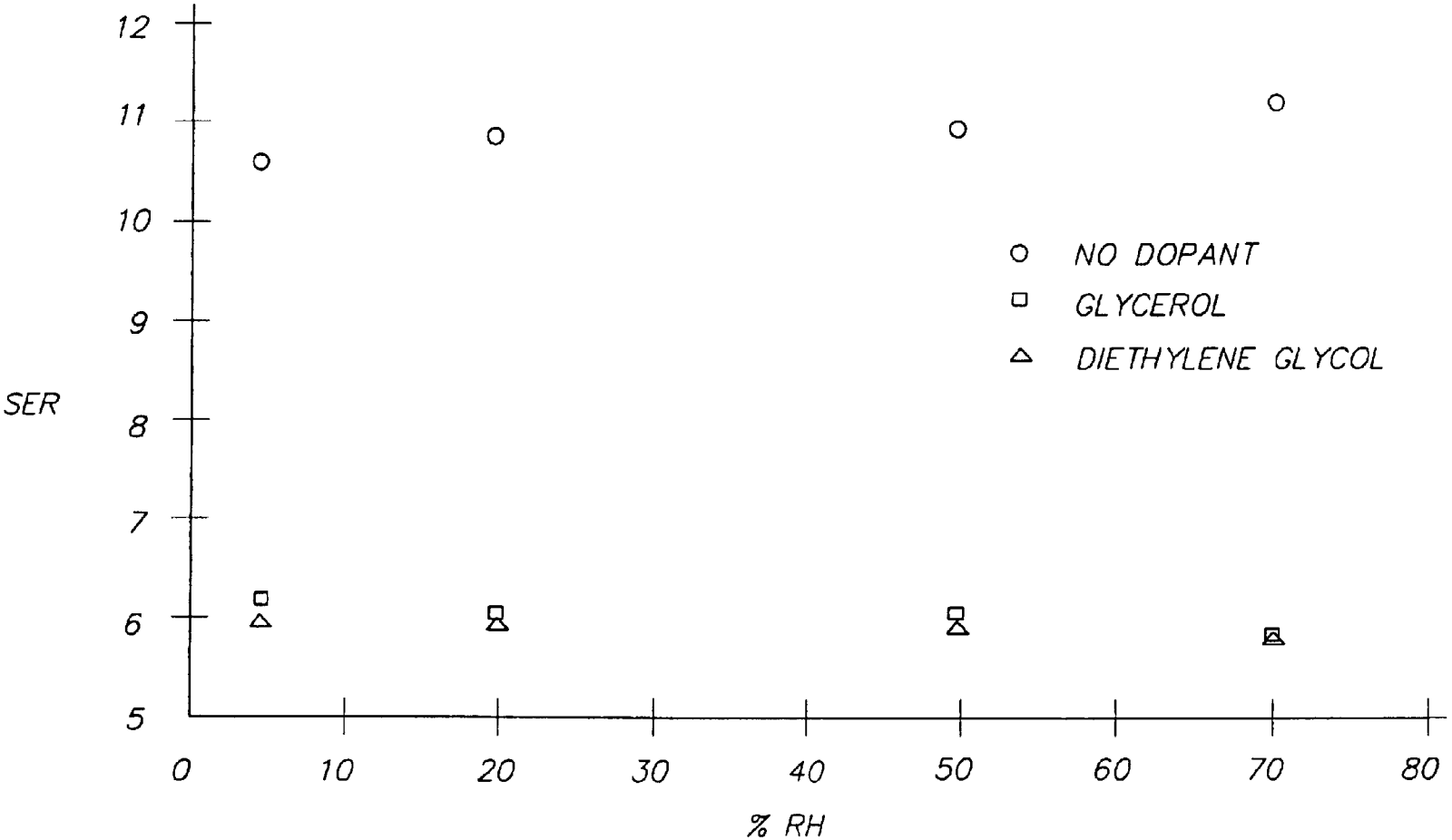
FIG. 2 shows the percentage of relative humidity in the sublayer.

As shown by the data in Table 1, the use of an organic compound neutral charge conductivity enhancer in the antistatic layer formulation in combination with Baytron P™ and gelatin provided significantly superior performance in terms of surface electrical resistivity compared with antistatic layer compositions containing only Baytron P and gelatin. To clearly indicate the improvement in conductivity achieved by this invention, the data in Table 1 relating SER to % Baytron P™ in the gelatin-based antistatic layer coated at the constant (16.1 mg/m2) Baytron P™ coverage are plotted in FIG. 1 (Examples 1–21). The data plotted in FIG. 2 (Examples 5, 12, 19)represent an assessment of humidity dependence of surface resistivity (SER) for the selected formulations described in Table 1.

The invention has been described in detail with particular reference to certain preferred embodiments thereof, but it will be understood that variations and modification can be effected within the spirit and scope of the invention.

What is claimed is:

1. An imaging material comprising a support having disposed thereon:

a) at least one photosensitive silver halide-containing image-forming layer that comprises gelatin, and b) directly under said image-forming layer, at least one transparent electrically conductive antistatic layer that comprises electronically conductive polymer particles, a neutral-charge conductivity enhancer, and a polymeric binder consisting essentially of gelatin.

2. The imaging material of claim 1 wherein said electronically conductive polymer particles comprise from 5 to 95 weight % of the total weight of said at least one antistatic layer.

3. The imaging material of claim 1 wherein said support is an unsubbed support.

4. The imaging material of claim 1 wherein said neutral-charge conductivity enhancer is present in an amount from 0.02 to 90 weight % based on the total weight of said antistatic layer.

5. The imaging material of claim 1 wherein said electronically conductive polymer particles comprise a pyrrole-, thiophene-, or aniline-containing polymer.

6. The imaging material of claim 1 wherein said antistatic layer comprises electronically conductive polymer particles of a polythiophene present in a cationic form with a polyanion, said polythiophene comprising recurring units defined by the following Formula I wherein n is about 5 to 1000 and wherein $R^1$ and $R^2$ are independently hydrogen or a substituted or unsubstituted alkyl group having 1 to 4 carbon atoms, or together form a substituted or unsubstituted group or a substituted or unsubstituted 1,2-cyclohexylene group:

I

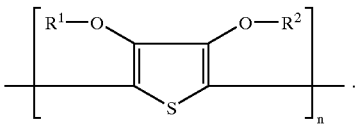

7. The imaging material of claim 1 wherein said antistatic layer is a subbing layer on said support and has said at least one image-forming layer disposed thereon.

8. The imaging material of claim 1 wherein said neutral-charge conductivity enhancer is:

(A) represented by the following Formula II:

$$(OH)_n—R—(COX)_m \quad \text{II}$$

wherein m and n are independently an integer of from 1 to 20, R is an alkylene group having 2 to 20 carbon atoms, an arylene group having 6 to 14 carbon atoms in the arylene chain, a pyran group, or a furan group, and X is —OH or —NYZ, wherein Y and Z are independently hydrogen or an alkyl group; or (B) a sugar, sugar derivative, polyalkylene glycol, or glycerol compound; or (C) selected from the group consisting of N-methylpyrrolidone, pyrrolidone, caprolactam, N-methyl caprolactam, or N-octylpyrrolidone.

9. The imaging material of claim 8 wherein said neutral-charge conductivity enhancer is a N-methylpyrrolidone, pyrrolidone, caprolactam, N-methylcaprolactam, N-octylpyrrolidone, sucrose, glucose, fructose, lactose, sugar alcohol, 2-furan carboxylic acid, 3-furan carboxylic acid, sorbitol, glycol, ethylene glycol, glycerol, diethylene glycol, or triethylene glycol, or a mixture of any two or more of these compounds.

10. The imaging material of claim 9 wherein said neutral-charge conductivity enhancer is N-methylpyrrolidone, pyrrolidone, caprolactam, N-methyl caprolactam, or N-octylpyrrolidone.

11. The imaging material of claim 9 wherein said neutral-charge conductivity enhancer is ethylene glycol, diethylene glycol or glycerol.

12. The imaging material of claim 6 wherein said polyanion is polystyrene sulfonic acid.

13. The imaging material of claim 9 wherein said neutral-charge conductivity enhancer is one or more than one compound selected from the group consisting of N-methylpyrrolidone, sorbitol, ethylene glycol, glycerol, and diethylene glycol.

14. The imaging material of claim 9 wherein said neutral-charge conductivity enhancer is ethylene glycol, glycol or glycerol.

15. The imaging material of claim 1 wherein said electronically conductive polymer particles exhibit a packed powder specific resistivity of $10^5$ ohnm.cm or less.

16. The imaging material of claim 1 wherein said electronically conductive polymer particles have a mean diameter of 0.5 $\mu$m or less.

17. The imaging material of claim 1 wherein said electronically conductive polymer particles have a mean diameter of 0.1 $\mu$m or less.

18. The imaging material of claim 1 wherein said electronically conductive polymer particles are present in said antistatic layer at a dry coverage of from 0.002 to 0.5 g/m$^2$.

19. The imaging material of claim 18 wherein said electronically conductive polymer particles are present in said antistatic layer at a dry coverage of from 0.003 to 0.1 g/m$^2$.

20. The imaging material of claim 1 wherein said at least one antistatic layer has a surface electrical resistivity of less than $1\times10^{12}$ ohm per square.

21. The imaging material of claim 20 wherein said at least one antistatic layer has a surface electrical resistivity of less than $1\times10^{10}$ ohm per square.

22. The imaging material of claim 20 wherein said at least one antistatic layer has a surface electrical resistivity of less than $1\times10^{8}$ ohm per square.

23. The imaging material of claim 1 wherein said support comprises a poly(ethylene terephthalate), poly(ethylene naphthalate), or cellulose acetate film, or an uncoated, resin coated, laminated, or synthetic paper.

24. The imaging material of claim 1 wherein said antistatic layer further comprises an antihalation composition.

25. The imaging material of claim 1 comprising at least one of said antistatic layers on each side of said support.

26. The imaging material of claim 1 comprising at least one photosensitive silver halide-containing layer on each side of said support.

27. The imaging material of claim 1 comprising at least one of said antistatic layers on each side of said support directly underneath said at least one photosensitive silver halide-containing layer.

28. The imaging material of claim 1 wherein said image-forming layer is a photosensitive, thermally developable layer.

29. The imaging material of claim 1 wherein said image-forming layer is a black-and-white photographic silver halide emulsion layer.

30. The imaging material of claim 1 wherein said at least one image-forming layer is a color photographic silver halide emulsion layer.

31. The imaging material of claim 1 that is a black-and-white photographic film or paper.

32. The imaging material of claim 31 that is a black-and-white radiographic film.

33. The imaging material of claim 1 that is an infrared radiation sensitive imaging or scannable material.

34. The imaging material of claim 1 that is a color photographic color negative or reversal film, color motion picture film or print, or a photographic color paper.

* * * * *